US005775003A

United States Patent [19]

Goodwin, III

[11] Patent Number: 5,775,003

[45] Date of Patent: Jul. 7, 1998

[54] PORTABLE SENSOR FOR DRY KILN SAMPLING

[75] Inventor: Thomas E. Goodwin, III, Green Cove Springs, Fla.

[73] Assignee: U.S. Natural Resources, Inc., Vancouver, Wash.

[21] Appl. No.: 653,257

[22] Filed: May 24, 1996

[51] Int. Cl.[6] ..... F26B 21/06

[52] U.S. Cl. ..... 34/191; 34/493

[58] Field of Search ..... 34/191, 217, 218, 34/491, 493

[56] References Cited

U.S. PATENT DOCUMENTS

| | | | |
|---|---|---|---|
| 3,744,144 | 7/1973 | Weis | 34/403 |
| 4,106,215 | 8/1978 | Rosen | 34/217 |
| 4,862,599 | 9/1989 | Brunner | 34/191 |
| 5,325,604 | 7/1994 | Little | 34/493 |

*Primary Examiner*—Henry A. Bennett
*Assistant Examiner*—Gregory Wilson
*Attorney, Agent, or Firm*—Robert L. Harrington

[57] ABSTRACT

A dry kiln for wood products that has sample tunnels mounted strategic to each of the charges (stacks) of wood products that are to be dried. A board sample is mounted in the tunnel that is representative of the charges to be dried. A sensing device mounted in the tunnel and supporting the board sample continuously monitors the weight of the board sample and inputs the information to a controller. The moisture content of the board sample at any time during the cycle is ascertained by weight. The board sample in the tunnel is subjected to the same drying conditions as the charge and therefore the moisture content of the charge will be the same as the board sample. The continuous weight monitoring of the board sample is accordingly used by the controller to control the dry cycle.

6 Claims, 3 Drawing Sheets

PORTABLE SENSOR FOR DRY KILN SAMPLING

FIELD OF THE INVENTION

This invention relates to a dry kiln for drying lumber and more particularly to an automatic sensing device for sensing the moisture content of a sample board and furthermore is portable for placement of the sample board at desired positions around a charge of lumber being dried.

BACKGROUND OF THE INVENTION

Lumber produced in a lumber mill must most often be dried before it can be marketed. A board not properly dried and used, e.g., for making furniture may split or warp and thereby ruin the item produced from that board.

Drying the boards is a long and tedious process. Preferably boards would be dried individually as each board is different in its drying properties. A thick board will dry more slowly than a thin board. Different types of wood will dry differently and even the same type boards of the same type of wood will have different moisture content.

A board can be dried slowly without concern but it can also be dried at different rates to speed up the process, i.e., it can be dried slowly to a certain moisture content and then dried more rapidly, also without concern for ruining the boards. The latter process is far more desirable as the time of drying impacts the cost substantially.

Using samples placed inside the dry kiln which are periodically weighed (to project changes in moisture content) is a benefit to determining when the desired moisture content has been reached that permits the faster drying procedure. However, the drying kilns are extremely hot and such sampling previously required first cooling the dry kiln interior, removing the sample, replacing the sample and heating the kiln back up to the desired temperature. This interruption itself is time consuming and inexact because the test periods were partially guesswork and in any event were spaced apart at the outside limits of time delay to reduce the cool down interruptions.

The Little U.S. Pat. No. 5,325,604 provides for a continuous monitoring system with a provision of stationary sensors positioned adjacent the interior walls of the dry kiln. The position whereat the sensors are placed are intended to simulate the drying conditions of the lumber in the charge, but such is not always possible and the readings obtained are not necessarily representative of the lumber in the charge.

BRIEF DESCRIPTION OF THE INVENTION

In a preferred embodiment of the present invention a sensor is suspended from a charge-mountable support or carrier. In particular, the support has a pair of horizontally projected support legs that are configured to fit between tiers of lumber boards, i.e., as separated by the tier spacers referred to as stickers. The support legs project from the charge and support a holding platform from which a monitoring device or sensor or weighing scale, hereafter collectively referred to as a sensor, is suspended. The sensor is designed to hold a board sample in suspension and stabilizers on each side of the sample fix the orientation of the board.

Flexible cables between a controller outside the kiln and the sensors provides the necessary portability of the device while allowing monitoring of the sensor readings. Whereas air flow through the kiln varies depending on a number of factors, the samples are placed at various positions around the charge and the samples themselves vary in thickness and wood type to truly represent the charge being dried. The stabilization of the board prevents swaying and turning of the board samples as the air movement shifts, again to more closely represent the exposure actually experienced by the boards in the charge.

Preferably sides and bottom walls are added to the support leaving open back and front ends (the structure sometimes hereafter being referred to as a tunnel). The front and/or back end of the tunnel may be provided with movable baffles to alter air flow past the sample. These and other features and the benefits provided will become more apparent upon reference to the following detailed description having reference to the accompanying drawings.

DESCRIPTION OF THE PREFERRED EMBODIMENT

Figure 1:
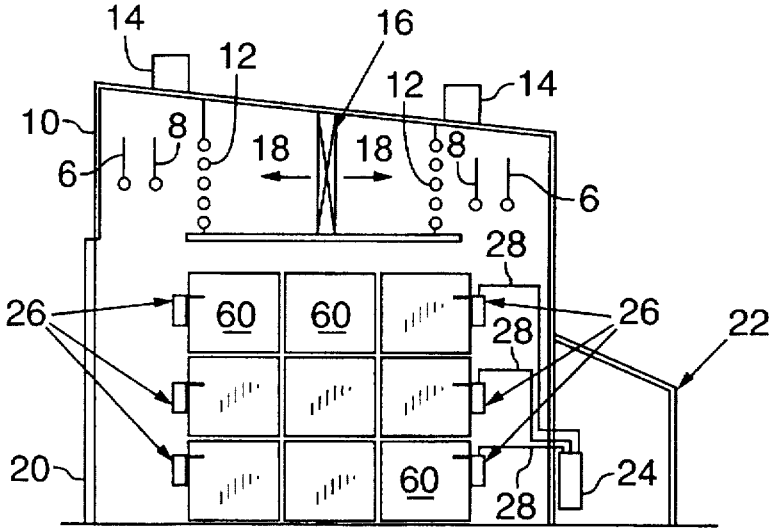
FIG. 1 is a view of a drying kiln.
Figure 2:
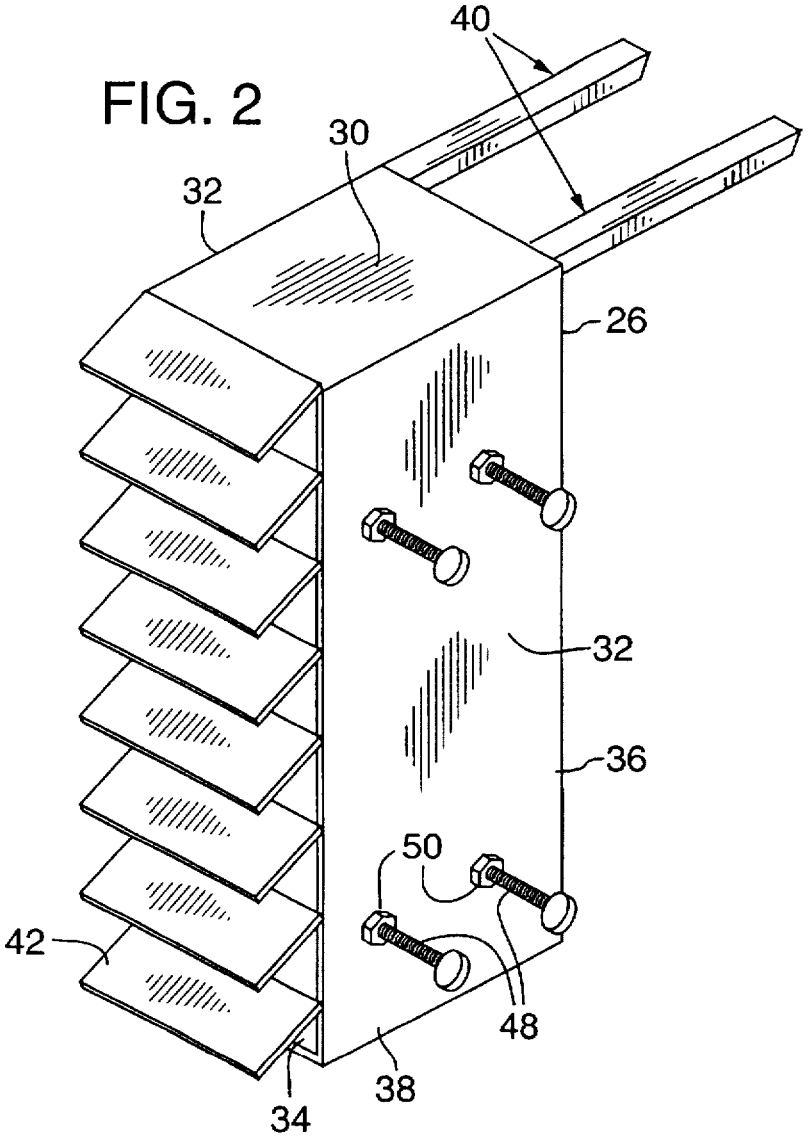
FIG. 2 is a view of a sensor device (tunnel) utilized in the kiln of FIG. 1.
Figure 3:
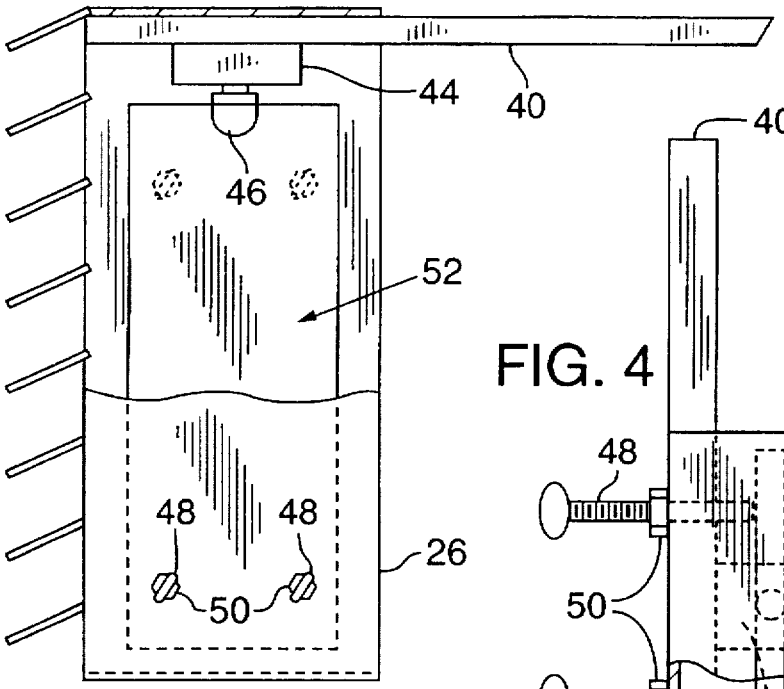
FIG. 3 is a side view of the tunnel of FIG. 2 partially in section.

FIG. 1 schematically illustrates a kiln 10 for drying lumber products. The kiln 10 is typically a large building that has insulated walls and ceiling and is arranged to have a controlled environment for drying multiple charges (stacks) of lumber products such as boards according to a determined drying schedule. Basically the dry bulb temperature and the wet bulb temperature of the air within the kiln is controlled to establish the desired drying schedule. The temperature as well as the humidity is controlled to provide a controlled rate of drying of the lumber products. The dry and wet bulb temperatures are monitored throughout the drying cycle and are controlled according to an established drying cycle. The temperature sensor for the dry bulb temperature is indicated by 6 and the temperature sensor for the wet bulb temperature is indicated by 8.

The kiln 10 has a heating system 12 for heating the air within the kiln and the air that may be introduced into the kiln. The heating system 12 further includes apparatus for releasing moisture laden air from the dry kiln into the atmosphere as required for drying. A venting system 14 is provided to exhaust moisture laden air to the atmosphere and also to introduce ambient air into the kiln. An air circulating system 16 circulates the air within the kiln through and around the charges (stacks) of lumber products placed within the kiln 10. The circulating system 16 circulates the air within the kiln and is capable of reversing the air flow as indicated by arrows 18. A door 20 provides access to the kiln 10 for the placement and removal of the charges (stacks) of lumber.

A control room 22 is provided adjacent to the kiln 10 to house an automatic kiln controller 24, such as a computer and ancillary equipment. The controller 24 controls the drying cycle of the kiln 10. The dry bulb sensor 6 and the wet bulb sensor 8 continuously output a signal to the controller 24. Additionally support platforms, in the form of sample tunnels 26 which will later be described and illustrated, are coupled to the controller 24.

Referring now also to FIGS. 2–5, board samples 52 are selected from the charges 60 that are to be dried and are cut to a length suited for the tunnel 26. The initial moisture content of the board samples 52 is measured by known methods and the board samples 52 are mounted in the sample tunnels 26. The sample tunnel 26 has a load cell (sensor) 44 that measures the weight of the board sample 52 on a continuous basis. The weight of the board sample 52 indicates the moisture content as may be calculated or ascertained from historical data. The weight of the board sample 52 at any given time will thus correlate to the moisture content of the board sample. The board samples 52 in the tunnels 26 are exposed to the same drying conditions as that of the charges 60 and therefore the moisture content of the board samples 52 will correspond to the moisture content of the boards in the charges 60. The data provided by the input of the load cells of each tunnel 26 provides continuous information on the moisture content of the charges 60 enabling the controller 24 to control the environment within the kiln 10 to accomplish the desired rate of drying.

In this embodiment, sample tunnels 26 are positioned strategic to the charges (stacks) 60 placed in the kiln 10. Signal conducting cables 28 which are flexible and movable inter-connect the sample tunnels 26 to the controller 24 to provide data input to the controller 24.

The tunnel 26 is a box like structure having a top 30, sides 32, ends 34, 36 and a bottom 38. Support struts (members) 40 extend from the top 30 adjacent end 36 and are of a size that will fit in the sticker space of the lumber charge 60. Typically the lumber charge 60 is layers of boards with each layer separated from another by a spacer referred to as a sticker. The space between the layers of boards of the charge 60 is referred to as the sticker space.

In this embodiment end 34 is provided with adjustable and removable louvers (baffles) 42 and the end 36 is open to provide access to the interior of the tunnel 26 and to provide air flow through the tunnel simulating air flow through the charge, i.e., through the sticker spaces. The louvers 42 are adjustable to alter the openings leading to the interior of the tunnel 26 and thus control the flow rate of the air flowing into and out of the sample tunnel 26. A known load cell 44 (FIGS. 3 & 4) is mounted to the top 30 in the interior of the sample tunnel 26 for continuously weighing a board sample 52. A cable 28 inter-connects the load cell 44 of each sample tunnel 26 to the controller 24.

The load cell 44 has a known clamping device indicated by 46. The clamping device 46 is preferably of the self centering type and is arranged to clamp and support a board sample 52 of the largest thickness contemplated. Adjustable stabilizers 48 are provided in each of the sides 32 of the sample tunnel 26. In this embodiment the stabilizers 48 are of the screw type and are each threadably mounted to a nut 50 secured to the sides 32. The stabilizers 48 may thus be adjusted toward and away from the central area of the tunnel 26.

Board samples 52 are selected from the charges 60 that are to be dried in the kiln 10. The board samples 52 are selected to be representative of the boards in the charge 60. The board samples 52 are cut to a length to fit in the tunnels 26. The moisture content of the board samples 52 is determined and from this information a determined drying cycle for the kiln 10 is input to the controller 24.

Figure 4:
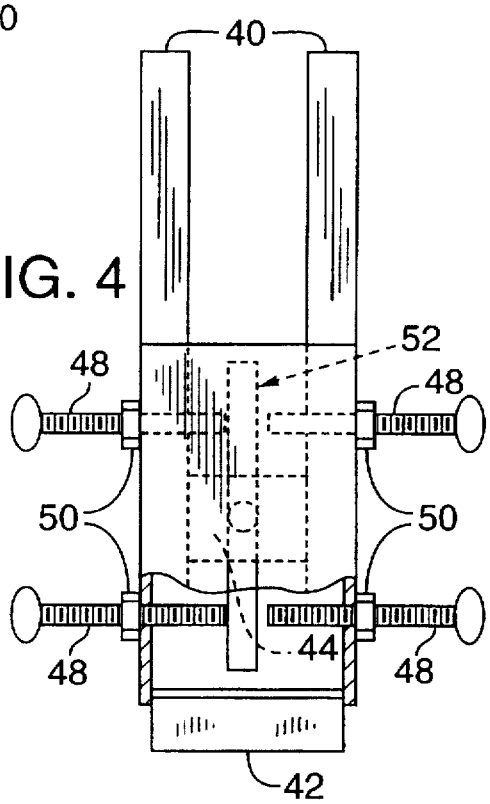
FIG. 4 is a top view of the tunnel of FIG. 2 partially in section.

A board sample 52 is inserted through the open end 36 or end 34 and mounted to the clamp 46 as best seen in FIG. 4. The stabilizers 48 are advanced to be in close proximity to opposed faces of the sample 52. The stabilizers 48 are positioned such that they will not affect the load register of the load cell 44 yet will stabilize the sample 52 when air is flowing into and through the sample tunnel 26. The louvers 42 on the end 34 of the tunnel 26 are adjusted to a desired opening and are removable allowing samples to be inserted from end 34.

Figure 5:
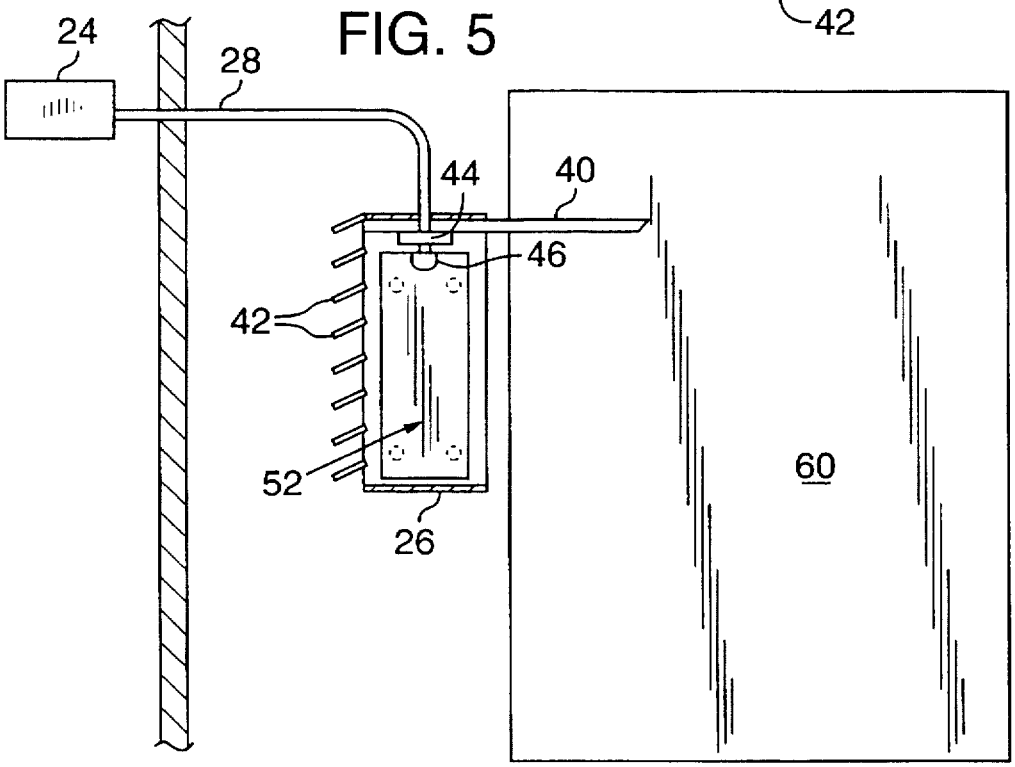
FIG. 5 is a section view of the tunnel of FIG. 2 mounted to a lumber charge in the kiln of FIG. 1.

Each tunnel 26 with a board sample 52 mounted therein is mounted to a charge 60 (or at various positions around each charge) as illustrated in FIG. 5. The louvers 42 are adjusted to provide the same air flow conditions over and around the board sample 52 in the tunnel 26 as is experienced by the boards of the charge 60. The air flow through the tunnel 26 will simulate the air flow flowing through and around the charge 60 so that the sample board 52 will be dried at the same rate as the boards in the charge 60. A cable 28 extends from each tunnel 26 and is connected to the controller 24.

Figure 6:
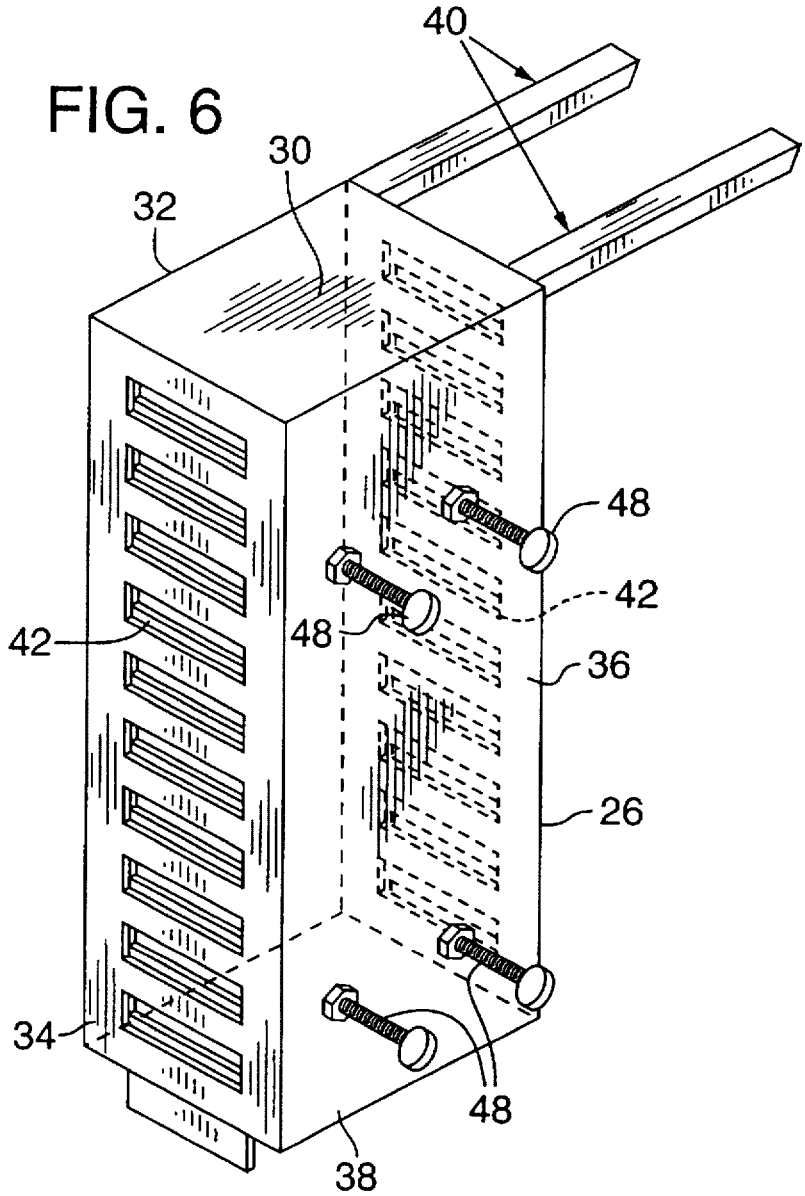
FIG. 6 is a view of an alternate sensor device (tunnel) utilized in the kiln of FIG. 1.

FIG. 6 illustrates an alternate tunnel 26 for placement in the kiln 10 of FIG. 1. The tunnel 26 illustrated in FIG. 6 is similar to the tunnel 26 illustrated in FIGS. 2, 3, 4 and 5 except that the end 36 is also provided with adjustable and removable louvers (baffles) 42. The baffles 42 are removable to provide access to the interior of the tunnel 26 for ready placement and removal of board samples 52. The tunnel 26 of FIG. 6 is also arranged with a load cell 44 and adjustable stabilizers 48 (50).

The provision of adjustable and removable baffles 42 on each of the ends 34, 36 provides for added control in simulating the same air flow (and thus the same drying conditions) around the board sample 52 placed in the tunnel 26.

A typical array of tunnels 26 mounted to the charges 60 is illustrated in FIG. 1. It will be appreciated that the illustration is given by way of example and the tunnels 26 may be arranged on the charges 60 in a manner to best simulate the drying conditions that is experienced on the charges 60. Dry kilns are designed for an even and uniform air flow through the charges, however, even with the best design some charges may dry at a more rapid rate than other charges placed at different locations. The placement of a tunnel 26 or tunnels 26 strategic to each charge ensures that the moisture content of the boards of each charge will be readily ascertained and the drying schedule may be adjusted to suit the existing conditions. Whereas the slower drying temperature is never a problem, the determination of when to increase the drying temperature may be a compromise.

The continuous feedback of the weights of the board samples 52 in the tunnels 26 in conjunction with the dry and wet bulb temperatures enables a drying cycle to be established as a best overall drying cycle which is completed without interruption. The data input from each drying cycle will enable a user to refine the determined drying cycles as relating to the type wood to be dried, the dimensions of the wood to be dried and so forth. By utilizing and implementing the input data the drying cycles for all types of wood products may be enhanced.

Those skilled in the art will recognize that modifications and variations may be made without departing from the true spirit and scope of the invention. The invention is therefore not to be limited to the embodiments described and illustrated but is to be determined from the appended claims.

I claim:

1. A system for monitoring the wet-dry conditions of a charge of lumber being dried in a dry kiln comprising:

a portable sensing device including a carrier, a support member for the carrier and a sensor, said sensor supported by said carrier and said carrier supported by said support member, said support member adapted for supporting said carrier and sensor at varied locations adjacent a charge in a dry kiln;

a controller located outside the dry kiln and a connecter connecting the controller to the sensor at said varied locations of the portable sensing device;

said sensor adapted for replacably holding a selected lumber sample for sensing the weight of the selected lumber sample during a drying process in a dry kiln, and stabilizers provided on the carrier for maintaining the lumber sample being held by the sensor in a stabilized orientation.

2. A system as defined in claim 1 including multiple sensors for sensing multiple samples representing the lumber in a charge of lumber being dried in the dry kiln, and multiple connecters connecting the sensors to the controller, said controller programmed to effectively control the drying process of the lumber charge through monitoring of the multiple samples.

3. A system as defined in claim 1 wherein the support member is a horizontally protruded leg configured to removably attach to the lumber charge and said connecter is a movable flexible connecting cable.

4. A system as defined in claim 3 wherein the lumber in the charge is layered in tiers separated by spacers providing openings between the tiers, said support member configured to fit the openings so as to be sandwiched between tiers of lumber.

5. A system as defined in claim 1 wherein the carrier has a top, a pair of opposed sides and a bottom, the sensor being supported by the top of the tunnel and said sample suspended from the sensor between the sides, and stabilizing rods adjustably protruded from the sides into a position adjacent the opposite faces of the board sample to stabilize the board sample.

6. A system as defined in claim 5 wherein the carrier includes a baffled front end and open back end, said front end having adjustable baffles for adjusting air flow through the carrier and across the sample.

* * * * *